US010434807B2

(12) United States Patent
Schaede

(10) Patent No.: US 10,434,807 B2
(45) **Date of Patent: *Oct. 8, 2019**

(54) COMBINED PRINTING PRESS

(71) Applicant: KBA-NotaSys SA, Lausanne (CH)

(72) Inventor: Johannes Georg Schaede, Würzburg (DE)

(73) Assignee: KBA-NOTASYS SA, Lausanne (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/510,650

(22) PCT Filed: Sep. 11, 2015

(86) PCT No.: PCT/IB2015/056967

§ 371 (c)(1),
(2) Date: Mar. 10, 2017

(87) PCT Pub. No.: WO2016/038572

PCT Pub. Date: Mar. 17, 2016

(65) Prior Publication Data

US 2017/0190197 A1 Jul. 6, 2017

(30) Foreign Application Priority Data

Sep. 12, 2014 (EP) ..... 14184681

(51) Int. Cl.
*B41M 3/14* (2006.01)
*B41F 11/02* (2006.01)
(Continued)

(52) U.S. Cl.
CPC ..... *B41M 3/148* (2013.01); *B41F 5/00* (2013.01); *B41F 11/02* (2013.01); *B41F 15/14* (2013.01);
(Continued)

(58) Field of Classification Search
CPC .. B41F 5/18; B41F 11/02; B41F 31/18; B41F 31/20; B41F 5/00; B41F 15/14;
(Continued)

(56) References Cited

U.S. PATENT DOCUMENTS 5,671,671 A 9/1997 Wyssmann et al.
7,047,883 B2 5/2006 Raksha et al.
(Continued)

FOREIGN PATENT DOCUMENTS

DE 10 2011 080 321 3/2012
EP 0 723 864 7/1996
(Continued)

OTHER PUBLICATIONS

Japan Patent Office Action dated Jul. 23, 2019 in corresponding Japan patent application 2017-513230, which Action cites References 3 and 4. The English language equivalents of the other cited References 1, 2, and 5 have already been cited in the USPTO file for U.S. Appl. No. 15/510,650.

*Primary Examiner* — David H Banh
(74) *Attorney, Agent, or Firm* — Nixon & Vanderhye PC

(57) ABSTRACT

There is described a combined printing press (10) for the production of security documents, in particular banknotes, comprising a screen printing group (3) and a numbering group (4) adapted to process printed substrates in the form of individual sheets or successive portions of a continuous web. The screen printing group (3) is located upstream of the numbering group (4) and comprises at least one screen printing unit (32-33) designed to print a pattern of optically-variable ink, which optically-variable ink contains flakes that can be oriented by means of a magnetic field. The screen printing group further comprises a magnetic unit (36) located downstream of the screen printing unit (32-33), which magnetic unit (36) is designed to magnetically induce an optically-variable effect in the pattern of optically-vari-
(Continued)

able ink applied by the screen printing unit (32-33) prior to drying/curing of the optically-variable ink. The screen printing group (3) further comprises at least one drying/curing unit (37) designed to dry/cure the pattern of optically-variable ink in which the optically-variable effect has been induced by the magnetic unit (36), prior to transfer of the printed substrates to the numbering group (4).

13 Claims, 2 Drawing Sheets

(51) Int. Cl.

| | |
|---|---|
| ***B41F 5/00*** | (2006.01) |
| ***B41F 15/14*** | (2006.01) |
| ***B41M 1/02*** | (2006.01) |
| ***B41M 1/12*** | (2006.01) |
| ***B41M 3/00*** | (2006.01) |
| ***B41M 7/00*** | (2006.01) |

(52) U.S. Cl.
CPC ..... *B41M 1/02* (2013.01); *B41M 1/12* (2013.01); *B41M 3/008* (2013.01); *B41M 7/0072* (2013.01); *B41P 2215/50* (2013.01); *B41P 2217/11* (2013.01); *B41P 2217/50* (2013.01)

(58) Field of Classification Search
CPC ..... B41K 3/126; B41M 1/02; B41M 1/12; B41M 3/008; B41M 7/0072; B41M 3/148; B41P 2215/50; B41P 2217/11; B41P 2217/50
See application file for complete search history.

(56) References Cited

U.S. PATENT DOCUMENTS

| | | | | |
|---|---|---|---|---|
| 7,691,468 | B2 | 4/2010 | Benninger et al. | |
| 8,286,551 | B2 | 10/2012 | Gygi | |
| 8,499,687 | B2 | 8/2013 | Gygy et al. | |
| 8,621,997 | B2 | 1/2014 | Gygi | |
| 8,726,805 | B2 | 5/2014 | Stöhr et al. | |
| 8,800,447 | B2 | 8/2014 | Schwitzky et al. | |
| 8,813,644 | B2 | 8/2014 | Gygi et al. | |
| 9,283,743 | B2 | 3/2016 | Schaede et al. | |
| 10,279,582 | B2 * | 5/2019 | Schaede | B41F 11/02 |
| 2004/0051297 | A1 | 3/2004 | Raksha et al. | |
| 2006/0150854 | A1 | 7/2006 | Benninger et al. | |
| 2006/0213384 | A1 * | 9/2006 | Reinhard | G07D 7/12 101/216 |
| 2006/0219107 | A1 * | 10/2006 | Gygi | B41F 15/0804 101/129 |
| 2008/0271620 | A1 * | 11/2008 | Hoier | B41F 11/02 101/216 |
| 2009/0095178 | A1 | 4/2009 | Schwitzky et al. | |
| 2009/0101030 | A1 | 4/2009 | Stohr et al. | |
| 2010/0139511 | A1 * | 6/2010 | Schaede | B41F 9/002 101/156 |
| 2010/0170408 | A1 * | 7/2010 | Gygi | B05D 3/207 101/116 |
| 2010/0236432 | A1 * | 9/2010 | Foresti | B41F 9/021 101/167 |
| 2010/0242753 | A1 * | 9/2010 | Gygi | B41F 15/12 101/116 |
| 2011/0017081 | A1 | 1/2011 | Gygi | |
| 2013/0183067 | A1 * | 7/2013 | Degott | B41M 3/14 399/267 |
| 2013/0213246 | A1 * | 8/2013 | Schaede | B41F 11/02 101/76 |
| 2013/0298791 | A1 * | 11/2013 | Gygi | B05D 3/207 101/416.1 |
| 2016/0185102 | A1 | 6/2016 | Schaede et al. | |

FOREIGN PATENT DOCUMENTS

| | | |
|---|---|---|
| EP | 1 842 665 | 10/2007 |
| EP | 2 433 798 | 3/2012 |
| JP | 2002-240977 | 8/2002 |
| JP | 2007-523761 | 8/2007 |
| WO | WO 2004/007095 | 1/2004 |
| WO | 2005/008606 A1 | 1/2005 |
| WO | WO 2005/000585 | 1/2005 |
| WO | WO 2005/002866 | 1/2005 |
| WO | WO 2006/129245 | 12/2006 |
| WO | WO 2007/060624 | 5/2007 |
| WO | WO 2008/102303 | 8/2008 |
| WO | WO 2011/145028 | 11/2011 |
| WO | WO 2012/038531 | 3/2012 |
| WO | WO 2014/037221 | 3/2014 |

* cited by examiner

COMBINED PRINTING PRESS

This application is the U.S. national phase of International Application No. PCT/IB2015/056967 filed 11 Sep. 2015, which designated the U.S. and claims priority to EP Patent Application No. 14184681.6 filed 12 Sep. 2014, the entire contents of each of which are hereby incorporated by reference.

TECHNICAL FIELD

The present invention generally relates to a combined printing press of the type comprising a screen printing group and a numbering group. The present invention is in particular applicable for the production of security documents, such as banknotes.

SUMMARY OF THE INVENTION

There is described a combined printing press for the production of security documents, in particular banknotes, comprising a screen printing group and a numbering group adapted to process printed substrates (i.e. printed material) in the form of individual sheets or successive portions of a continuous web. The screen printing group is located upstream of the numbering group and comprises at least one screen printing unit designed to print a pattern of optically-variable ink, which optically-variable ink contains flakes that can be oriented by means of a magnetic field. The screen printing group further comprises a magnetic unit located downstream of the screen printing unit, which magnetic unit is designed to magnetically induce an optically-variable effect in the pattern of optically-variable ink applied by the screen printing unit prior to drying/curing of the optically-variable ink. The screen printing group further comprises at least one drying/curing unit designed to dry/cure the pattern of optically-variable ink in which the optically-variable effect has been induced by the magnetic unit, prior to transfer of the printed substrates, to the numbering group.

Preferably, the magnetic unit includes a rotating magnetic cylinder assembly carrying magnetic-field generating devices on its circumference. In this particular context, it is advantageous to provide the at least one drying/curing unit so as to cooperate directly with the magnetic cylinder assembly, which at least one drying/curing unit is located on a downstream portion of the circumference of the magnetic cylinder assembly, i.e. a portion of the circumference of the magnetic cylinder assembly that is located before and close to the location where the printed substrates are taken away from the magnetic cylinder assembly. The purpose of this drying/curing unit is to initiate drying/curing of the ink pattern before the printed substrates are taken away from the magnetic cylinder assembly.

The drying/curing unit may advantageously be a UV curing unit, in particular a UV-LED curing unit.

Advantageously, a recto-verso varnishing group may further be provided downstream of the numbering group.

Further advantageous embodiments of the combined printing press are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

The present invention will be described in the particular context of a sheet-fed printing press for the production of security documents, such as banknotes.

Figure 1:
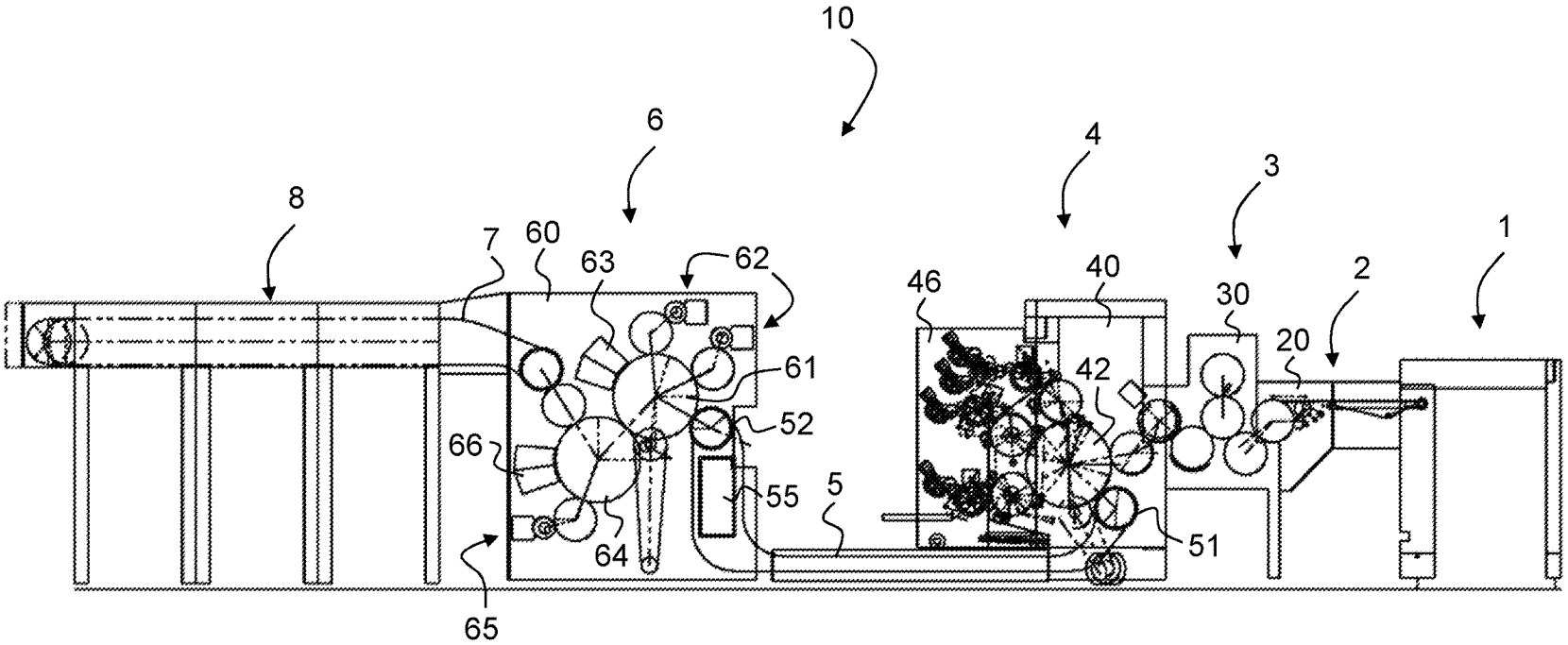
FIG. 1 is a schematic side view of a combined printing press in accordance with one embodiment of the invention.

FIG. 1 is a schematic side view of a combined printing press in accordance with one illustrative embodiment of the invention, which printing press is generally designated by reference numeral 10 and is configured to process individual sheets which are fed in succession through the printing press 10 from a sheet feeder 1 located upstream of the relevant printing groups to a delivery 8 located downstream of the relevant printing groups.

More precisely, individual sheets are fed in succession from the feeder 1 onto an infeed table 2 as is typical in the art and then via a suitable sheet transfer mechanism to a first printing group, namely a screen printing group 3, and then to a second printing group, namely a numbering group 4. In the illustrated example, the infeed table 2 forms part of an infeed module 20 which comprises a sheet transfer cylinder 21 feeding the sheets in succession to the screen printing group 3 (see also FIG. 2).

In the illustrated example, the sheets are further transported from the numbering group 4 via a suitable sheet transport system 5, such as chain gripper system, to a varnishing group 6 which is designed to varnish both sides of the sheets, in a manner similar to the solution described in International (PCT) Publication No. WO 2011/145028 A1, which is incorporated herein by reference in its entirety.

As schematically illustrated in FIG. 1, the varnishing group 6 is constructed as a varnishing module 60 supporting first and second cylinders 61, 64 where the recto side and the verso side of the sheets are varnished in succession. These cylinders 61, 64 are advantageously two-segment cylinders. More precisely, in the illustrated example, two varnishing units 62 are disposed about a part of the circumference of the first cylinder 61 in order to varnish the recto side of the sheets, and one varnishing unit 65 is disposed about a part of the circumference of the second cylinder 64 is order to varnish the verso side of the sheets. The varnishing units 62, 65 are advantageously designed as flexographic units.

A suitable drying unit, in particular a UV-curing unit, 63 is provided downstream of the two varnishing units 62 in order to dry/cure the recto side of the sheets before transfer thereof from the first cylinder 61 to the second cylinder 64. Likewise, a suitable drying unit, in particular a UV-curing unit, 66 is provided downstream of the varnishing unit 65 in order to dry/cure the verso side of the sheets before these are taken away from the second cylinder 64 to be transported by a sheet transport system 7 to the delivery 8.

The numbering group 4 consists in this example of a numbering module 40 supporting a sheet transfer cylinder or drum 41 and a two-segment impression cylinder 42 that transports the individual sheets coming from the screen printing group 3 in succession past three letterpress forme cylinders 43, 44, 45 that are distributed about a part of the circumference of the impression cylinder 42. In the present example, the first letterpress forme cylinder 43 can carry a letterpress printing plate used e.g. for printing a date and/or signature, while the two remaining letterpress forme cylinders 44, 45 are preferably designed as first and second numbering cylinders carrying a plurality of numbering boxes.

The letterpress forme cylinders 43, 44, 45 are inked by corresponding inking devices (not shown in FIG. 2) that are advantageously supported in a mobile inking carriage 46 that can be retracted away from the letterpress forme cylinders 43, 44, 45 during maintenance operations.

Figure 2:
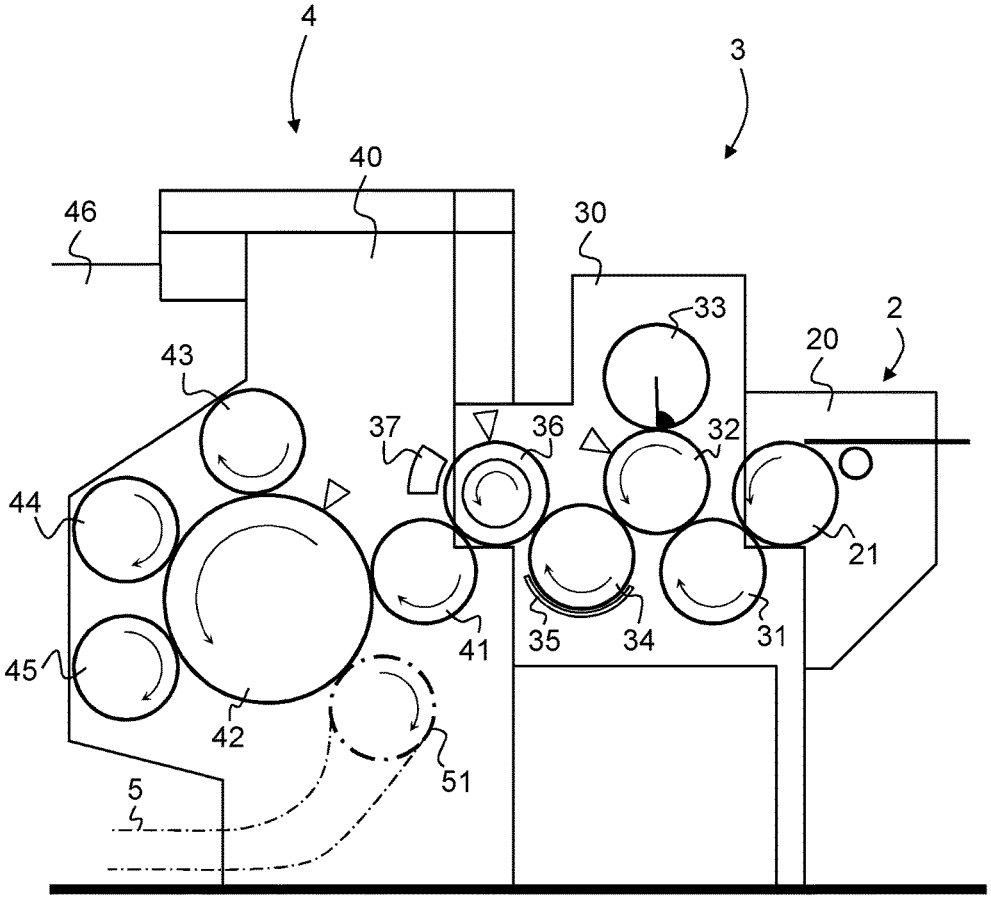
FIG. 2 is a schematic side view of the screen printing group and numbering group of the combined printing press of FIG. 1.

A numbering group 4 of the type shown in FIGS. 1 and 2 is known as such in the art, for instance from International (PCT) Publications Nos. WO 2006/129245 A2, WO 2007/060624 A1 and WO 2011/145028 A1, which publications are incorporated herein by reference in their entirety.

Once printed in the numbering group 4, the sheets are taken away from the impression cylinder 42 by the intermediate sheet transport system 5 for further transport to the previously-described varnishing group 6. In the illustrated example, the intermediate sheet transport system 5 is designed as a chain gripper system comprising a pair of endless chains carrying spaced-apart gripper bars for holding the leading edge of the sheets, which endless chain are driven between two pairs of chain wheels 51, 52, so that sheets are taken away from the impression cylinder 42 of the numbering group 4 and transported to the varnishing group 6 where the sheets are transferred to the first cylinder 61. As further illustrated in FIG. 1, a drying unit 55 (such as a UV-curing unit) is preferably provided along the path of the intermediate sheet transport to dry/cure the sheets (namely the recto side thereof) before transfer to the varnishing group 6.

Prior to being processed by the numbering group 4, the sheets are first processed by the screen printing group 3 that will now be described in greater detail.

In the example of FIGS. 1 and 2, the screen printing group 3 is advantageously designed to print the same side (i.e. the recto side) of the sheets as the subsequent numbering group 4. The screen printing group 3 is preferably constructed as a screen printing module 30 that is interposed between the infeed module 20 and the numbering module 40. More precisely, the screen printing module 30 is designed in such a way that it can be decoupled from the infeed module 20 and the numbering module 40 and that the infeed module 20 can be coupled directly to the feeding section of the numbering module 40.

The screen printing module 30 includes a one-segment sheet transfer cylinder 31 receiving sheets fed from the infeed table 2 and transferred by the sheet transfer cylinder 21, which sheet transfer cylinder 31 transfers the sheet to a one-segment impression cylinder 32 that cooperates with a one-segment screen (or stencil) cylinder 33. Ink is fed from the interior of the screen cylinder 33 and applied through the screen under the action of a squeegee in a manner known as such in the art (see e.g. EP 0 723 864 A1).

In accordance with the invention, the screen printing unit formed by the association of the impression cylinder 32 and the screen cylinder 33 is advantageously designed to apply a pattern of optically-variable ink, which optically-variable ink contains flakes that can be oriented by means of a magnetic field. Such ink may be a so-called Optically Variable Magnetic Ink (or OVMI®) as available from SICPA SA.

Once printed by the screen printing unit 32-33, the sheets are fed to another sheet transfer cylinder or drum 34 before reaching a magnetic unit 36 designed to magnetically induce an optically-variable effect in the pattern of optically-variable ink applied by the screen printing unit 32-33 prior to drying/curing of the optically-variable ink. This technology is known as the Spark® technology (OVMI® and Spark® being registered trademarks of SICPA HOLDING SA).

The purpose of the magnetic unit 36 is to induce a desired optically-variable effect in the pattern of optically-variable ink by subjecting the relevant portion of the pattern to a magnetic field exhibiting a suitable distribution of the magnetic field lines as generally described in e.g. International (PCT) Publications Nos. WO 2004/007095 A2, WO 2005/000585 A1 and WO 2005/002866 A1.

The magnetic unit 36 preferably includes a rotating magnetic cylinder assembly 36 carrying magnetic-field generating devices on its circumference (as for instance taught by International (PCT) Publications Nos. WO 2005/000585 A1, WO 2008/102303 A2, WO 2012/038531 A1, WO 2014/037221 A1 and European Patent Publication No. EP 2 433 798 A1). Preferably a drying/curing unit 37 (advantageously a UV curing unit) is located on a downstream portion of the circumference of the magnetic cylinder assembly 36, i.e. a portion of the circumference of the magnetic cylinder assembly 36 that is located before and close to the location where the sheet is taken away from the magnetic cylinder assembly 36. The purpose of this drying/curing unit 37 is to initiate drying/curing of the ink pattern before the sheet is taken away from the magnetic cylinder assembly 36.

It will be understood that the magnetic cylinder assembly 36 is brought in contact with the lower (i.e. verso) side of the sheets in the example of FIGS. 1 and 2, i.e. the side that is opposite to the side where the pattern of ink has been printed by the screen printing unit 32-33. On the other hand, the drying/curing unit 37 is located above the path of the sheets so as to dry/cure the ink printed on the upper (i.e. recto) side of the sheets.

In the illustrated example, the sheets are transferred away from the magnetic cylinder assembly 36 to the sheet transfer cylinder or drum 41 and then to the impression cylinder 42 of the numbering group 4.

In the example of FIGS. 1 and 2, the sheet transfer cylinder or drum 34 can advantageously be constructed as a sheet transfer drum designed to prevent or minimize contact with the printed side of the sheets. In addition, a suitable sheet guiding device 35 may be provided about the circumference of the sheet transfer cylinder or drum 34 in order to assist transport of the sheets from the impression cylinder 32 to the magnetic cylinder assembly 36.

The drying/curing unit 37 may advantageously be a LED unit, in particular a UV-LED curing unit.

Various modifications and/or improvements may be made to the above-described embodiments. In particular, while the embodiments discussed above relate to sheet-fed printing presses, the invention is also applicable to web-fed printing presses. In addition, the screen printing group 3 may comprise more than one screen printing unit and magnetic unit.

LIST OF REFERENCE NUMERALS USED THEREIN

10 combined printing press
1 feeder
2 infeed table
3 screen printing group
4 numbering group
5 intermediate sheet transport system (chain gripper system)/transport of printed sheets from numbering group 4 to varnishing group 6
6 (recto-verso) varnishing group

7 sheet delivery system (chain gripper system)/transport of printed sheets to delivery 8
8 delivery
20 infeed module
21 sheet transfer cylinder receiving sheets fed from infeed table 2
30 screen printing module
31 sheet transfer cylinder receiving sheets fed from infeed table 2 and transferred by sheet transfer cylinder 21 (one-segment cylinder)
32 impression cylinder (one-segment cylinder)
33 screen (stencil) cylinder cooperating with impression cylinder 32 (one-segment cylinder)
34 sheet transfer cylinder or drum (one-segment cylinder or drum)
35 sheet guiding device associated to sheet transfer cylinder or drum
36 rotating magnetic cylinder assembly (magnetic unit)
37 drying/curing unit (e.g. UV curing unit, preferably UV-LED curing unit) cooperating with magnetic cylinder assembly 36
40 numbering module
41 sheet transfer cylinder or drum (one-segment cylinder)
42 impression cylinder (two-segment cylinder)
43 letterpress forme cylinder (one-segment cylinder)
44 letterpress forme cylinder/first numbering cylinder (one-segment cylinder)
45 letterpress forme cylinder/second numbering cylinder (one-segment cylinder)
46 retractable/mobile inking carriage of numbering module 40
51 chain wheels of intermediate sheet transport system 5 where sheets are taken away from impression cylinder 42
52 chain wheels of intermediate sheet transport system 5 where sheets are transferred to first cylinder 61 of varnishing group 6
60 varnishing module
61 first cylinder of varnishing group (recto side/two-segment cylinder)
62 varnishing units (e.g. flexographic units) cooperating with first cylinder 61
63 first drying unit (UV curing unit) cooperating with first cylinder 61
64 second cylinder of varnishing group (verso side/two-segment cylinder)
65 varnishing unit (e.g. flexographic unit) cooperating with second cylinder 64
66 second drying unit (UV curing unit) cooperating with second cylinder 64

The invention claimed is:

1. A combined printing press for the production of security documents, in particular banknotes, comprising a screen printing group and a numbering group adapted to process printed substrates in the form of individual sheets or successive portions of a continuous web, wherein the screen printing group is located upstream of the numbering group and comprises at least one screen printing unit comprising at least one screen cylinder and an associated first impression cylinder and designed to print a pattern of optically-variable ink, which optically-variable ink contains flakes that can be oriented by means of a magnetic field, wherein the numbering group comprises at least one letterpress forme cylinder and an associated second impression cylinder, wherein the screen printing group further comprises a magnetic unit located downstream of the screen printing unit and upstream the numbering group, which magnetic unit is designed to magnetically induce an optically-variable effect in the pattern of optically-variable ink applied by the screen printing unit prior to drying/curing of the optically-variable ink, wherein the screen printing group further comprises at least one drying/curing unit designed to dry/cure the pattern of optically-variable ink in which the optically-variable effect has been induced by the magnetic unit, prior to transfer of the printed substrates to the numbering group, wherein the magnetic unit includes a rotating magnetic cylinder assembly carrying magnetic-field generating devices on its circumference, wherein the at least one drying/curing unit cooperates directly with the magnetic cylinder assembly and is located on a downstream portion of the circumference of the magnetic cylinder assembly before and close to the location where the printed substrates are taken away from the magnetic cylinder assembly.

2. The combined printing press as defined in claim 1, wherein the at least one drying/curing unit is a UV curing unit.

3. The combined printing press as defined in claim 2, wherein the at least one drying/curing unit is a UV-LED curing unit.

4. The combined printing press as defined in claim 1, wherein the screen printing group is designed to print the same side of the printed substrates as the numbering group.

5. The combined printing press as defined in claim 1, wherein the numbering group consists of a numbering module, and wherein the screen printing group is constructed as a screen printing module that is interposed between an infeed module of the combined printing press and the numbering module, the screen printing module being designed in such a way that it can be decoupled from the infeed module and the numbering module and that the infeed module can be coupled directed to a feeding section of the numbering module.

6. The combined printing press as defined in claim 1, further comprising a transfer cylinder or drum interposed between the screen printing unit and the magnetic unit.

7. The combined printing press as defined in claim 6, wherein the transfer cylinder or drum is constructed as a transfer drum designed to prevent or minimize contact with the printed side of the printed substrates.

8. The combined printing press as defined in claim 6, wherein a guiding device is provided about the circumference of the transfer cylinder or drum in order to assist transport of the printed substrates from the screen printing unit to the magnetic unit.

9. The combined printing press as defined in claim 1, further comprising a recto-verso varnishing group provided downstream of the numbering group.

10. The combined printing press as defined in claim 1, wherein the transport for the sheets between the first impression cylinder of the screen printing group and the second impression cylinder of the numbering printing group takes place via at least one sheet transfer cylinder.

11. The combined printing press as defined in claim 10, wherein the transport path for the sheets between the first impression cylinder of the screen printing group and the second impression cylinder of the numbering printing group is only based on co-operating cylinders.

12. A combined printing press for the production of security documents, in particular banknotes, comprising a screen printing group and a numbering group adapted to process printed substrates in the form of individual sheets or successive portions of a continuous web, wherein the screen printing group is located upstream of the numbering group and comprises at least one screen printing unit comprising at least one screen cylinder and an associated first impression cylinder and designed to print a pattern of optically-variable ink, which optically-variable ink contains flakes that can be oriented by means of a magnetic field, wherein the numbering group comprises at least one letterpress forme cylinder and an associated second impression cylinder, wherein the screen printing group further comprises a magnetic unit located downstream of the screen printing unit and upstream the numbering group, which magnetic unit is designed to magnetically induce an optically-variable effect in the pattern of optically-variable ink applied by the screen printing unit prior to drying/curing of the optically-variable ink, wherein the screen printing group further comprises at least one drying/curing unit designed to dry/cure the pattern of optically-variable ink in which the optically-variable effect has been induced by the magnetic unit, prior to transfer of the printed substrates to the numbering group, wherein the magnetic unit includes a rotating magnetic cylinder assembly carrying magnetic-field generating devices on its circumference, wherein the at least one drying/curing unit cooperates directly with the magnetic cylinder assembly and is located on a downstream portion of the circumference of the magnetic cylinder assembly before and close to the location where the printed substrates are taken away from the magnetic cylinder assembly, and wherein transport for the sheets between the first impression cylinder of the screen printing group and the second impression cylinder of the numbering printing group takes place via at least one sheet transfer cylinder.

13. The combined printing press as defined in claim 12, wherein the transport path for the sheets between the first impression cylinder of the screen printing group and the second impression cylinder of the numbering printing group is only based on co-operating cylinders.

* * * * *